United States Patent [19]

Sanderson

[11] Patent Number: 4,516,294

[45] Date of Patent: May 14, 1985

[54] SELF LOCKING HOLDER FOR AN ITEM OF JEWELRY

[76] Inventor: Dilworth Sanderson, 79 Waller Ave., White Plains, N.Y. 10605

[21] Appl. No.: 356,859

[22] Filed: Mar. 10, 1982

[51] Int. Cl.[3] ..... A41B 7/00

[52] U.S. Cl. ..... 24/41; 24/97; 24/100

[58] Field of Search ..... 24/41, 97, 100, 100.5, 24/102 PL, 211 R, 211 P, 212; 63/31

[56] References Cited

U.S. PATENT DOCUMENTS

| | | | |
|---|---|---|---|
| 2,461,845 | 2/1949 | Osterberg | 24/100 |
| 2,596,357 | 5/1952 | Anderson | 24/97 |
| 3,350,749 | 11/1967 | McIntyre | 24/97 |

FOREIGN PATENT DOCUMENTS

| | | | |
|---|---|---|---|
| 209495 | 4/1957 | Australia | 63/31 |

*Primary Examiner*—Gene Mancene
*Assistant Examiner*—David L. Tarnoff
*Attorney, Agent, or Firm*—Lilling & Greenspan

[57] ABSTRACT

An item of jewelry such as a cuff link which is provided with a self-locking holder in order to provide absolute security and assurance that the holder will not permit the item of jewelry to come loose and fall. The self-locking holder for an item of jewelry comprising: a U-shaped stem for holding the item of jewelry; a pin extending across the opening between the side members of the stem; a slidably and rotatably locking member mounted on the pin; and a spring for biasing the locking member toward one side member for locking the locking member in place.

10 Claims, 19 Drawing Figures

SELF LOCKING HOLDER FOR AN ITEM OF JEWELRY

BACKGROUND OF THE INVENTION

The present invention relates to a self-locking holder for an item of jewelry such as a cuff link.

Through the ages, cuff links have become a standard item of jewelry. Whereas most men's shirts today are provided with buttons, the finer dress shirts are provided with cuffs prepared for cuff links. Consequently, cuff links are normally an expensive item of jewelry designed to compliment such finer shirts. Whereas in the past, inexpensive cuff links were prevelant, they are today a highly regarded, and often very expensive item of jewelry, which therefore frequently attain a high sentimental value.

Although cuff links, as well as other items of jewelry, have become more expensive, the means and devices for holding these items of jewelry have remained substantially the same as in the past. With cuff links, in particular, their holders have traditionally been a compromise between function and cost. For example, the U.S. Pat. Nos. Des. 70,769; 2,177,443; 2,252,851; and 2,270,677 disclose a variety of standard cuff link holders which represent a compromise between their ability to perform the desired function of holding the respective cuff links with a reasonable degree of security and ease of manufacture. None of these cuff link holders, however, provide completely secure means for retaining the cuff links on a shirt cuff, whether or not the shirt is being worn.

SUMMARY OF THE INVENTION

It is a primary object of the present invention to provide a holder for an item of jewelry, such as a cuff link, which is capable of holding the item with a high degree of security.

It is a further object of the present invention to provide a holder for an item of jewelry which may be manufactured reasonably inexpensively.

These objects, as well as other objects which will become apparent from the discussion that follows, are achieved, according to the present invention, by providing a self-locking holder for an item of jewelry which comprises four parts:

(a) A U-shaped stem adapted to hold the item of jewelry. The stem has two side members forming the legs of the "U" and defining an opening between them.

(b) A pin extending across the opening between the two side members of the stem. The pin has a non-circular, e.g. square, cross-section along a first portion of its length near one side member and a circular cross-section along a second portion of its length near the other side member.

(c) A locking member slidably and rotatably mounted on the pin within the opening. The locking member has a hole through it to receive the pin. The cross-section of this hole, at least on one side of the locking member, matches the non-circular cross-section of the pin in such a way that, when the locking member is positioned on the pin over the first portion of its length, it is prevented from rotating. The locking member is smaller in width than the distance between the two side members, permitting the locking member to slide back and forth on the pin within the opening.

(d) A spring, arranged for biasing the locking member toward that one side member which is adjacent the first portion of the pin with the non-circular cross-section.

From the foregoing description, it may be seen that the locking member of the self-locking holder may be rotated on the pin by first sliding it away from the first portion of the pin having the non-circular cross-section against the force of the biasing spring. Thereafter, when the locking member has been rotated, the biasing spring will move it back to the position covering the first, non-circular portion of the pin. When it is in this position, the locking member is prevented from rotating on the pin because the matching cross-section of its hole is disposed over the non-circular cross-section of the pin.

An item of jewelry such as a cuff link which is provided with a self-locking holder according to the present invention may be worn with absolute security and assurance that the holder will not permit the item of jewelry to come loose and fall.

For a full understanding of the present invention, reference should now be made to the following detailed description of the preferred embodiments of the invention and to the accompanying drawings.

DESCRIPTION OF THE PREFERRED EMBODIMENT

Figure 1:
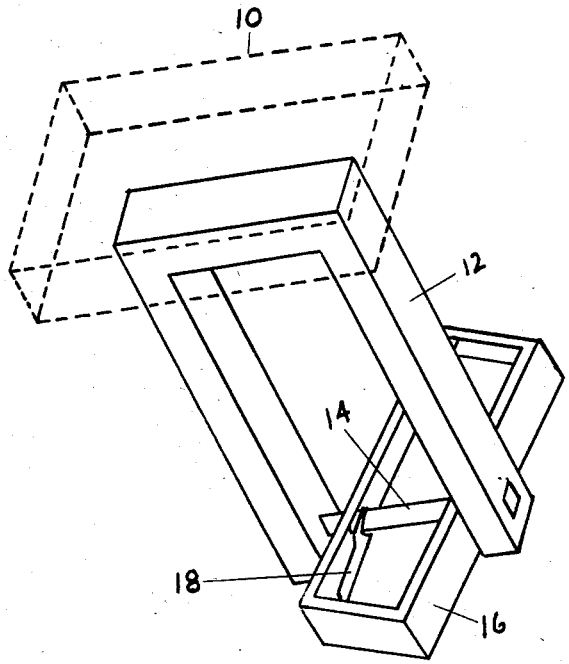
FIG. 1 is a perspective view of a self-locking holder for an item of jewelry such as a cuff link, according to a preferred embodiment of the present invention.

The preferred embodiment of the present invention will now be described with reference to FIGS. 1–8 of the drawings. Identical elements in the various figures are designated with the same reference numerals.

FIG. 1 shows a cuff link provided with a self-locking holder according to the present invention. The cuff link comprises a button 10 indicated in dashed lines, a U-shaped stem 12, a pin 14, a locking member 16 and a spring 18. The button 10 may be square, as indicated in FIG. 1, or any other shape created by the designer of the item of jewelry. When worn as a cuff link, the button 10 is the only part of the structure which is visible. It is assumed that this button 10 is relatively valuable and therefore warrants an extra measure of security when it is worn. The button 10 may be valuable in absolute monetary terms or it may have acquired a sentimental value.

FIGS. 2 and 3 illustrate the operation of the self-locking holder of FIG. 1. The individual parts of this holder are shown in detail in FIGS. 4–7. FIG. 8 shows an assembled cuff link with a button 10.

Figure 2A:
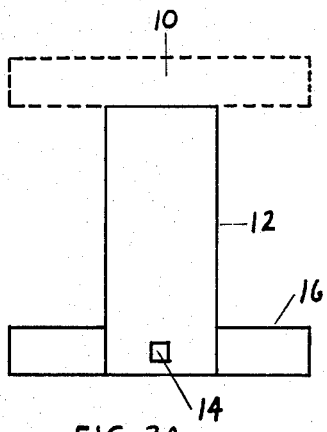
FIGS. 2A, 2B and 2C are side elevation views of the self-locking holder of FIG. 1 showing the locking member in three different positions, respectively.
Figure 3A:
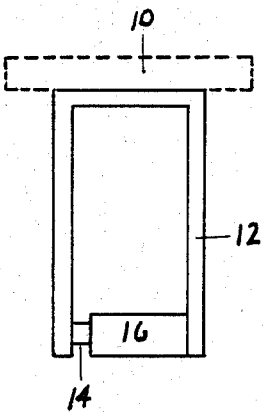
FIGS. 3A, 3B and 3C are front elevation views of the self-locking holder of FIG. 1 showing the locking member in the three different positions, respectively, also shown in FIGS. 2A–2C.

In FIGS. 2A and 3A, the locking member 16 is shown in its normal, holding (locking) position. It is arranged perpendicularly with respect to the stem 12 so as to prevent the cuff link from being removed from the cuff of the wearer. As shown in FIG. 3A, the locking member is positioned along the pin 14 adjacent the right-hand side member of the U-shaped stem. In this way, it covers a portion of the pin which has a square cross-section. Because the opening through the locking member for the pin also has a matching, e.g. square, cross-section, the locking member is prevented from rotating on the pin.

Figure 2B:
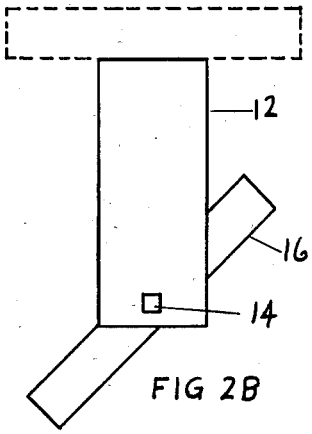
Figure 3B:
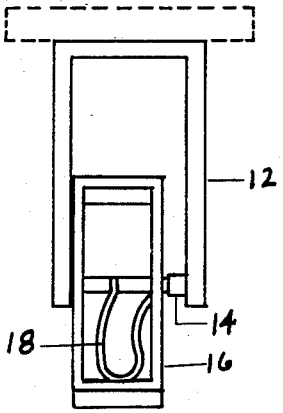

FIGS. 2B and 3B show the locking member 16 in an intermediate, rotatable position. As indicated in FIG. 3B, the locking member has been moved toward the left, in opposition to the force of the spring 18, and is in contact with the left-hand side member of the stem 12. In this position, the locking member covers a portion of the pin with a circular cross-section and is therefore permitted to rotate about the pin.

Figure 2C:
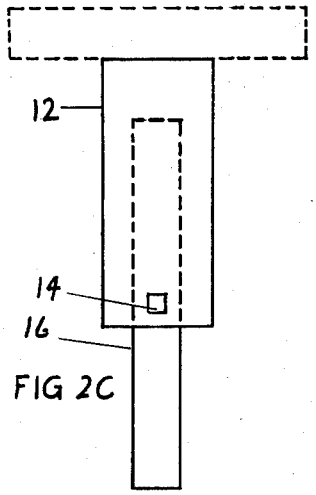
Figure 3C:
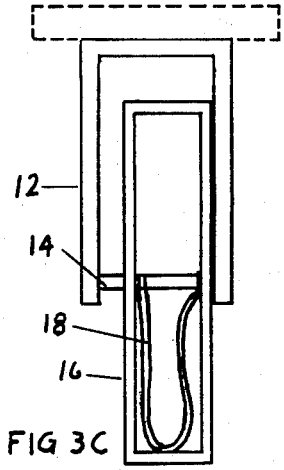

FIGS. 2C and 3C illustrate the locking member 16 in the release position. As may be seen, the locking member is here arranged in parallel with the stem 12 to permit the cuff link to be removed from a cuff. As shown in FIG. 3C, the locking member is again positioned adjacent the right-hand side member of the stem 12 so that it covers the portion of the pin having the square cross-section and is thereby locked in position.

Figures 4A, 4B, 4C:
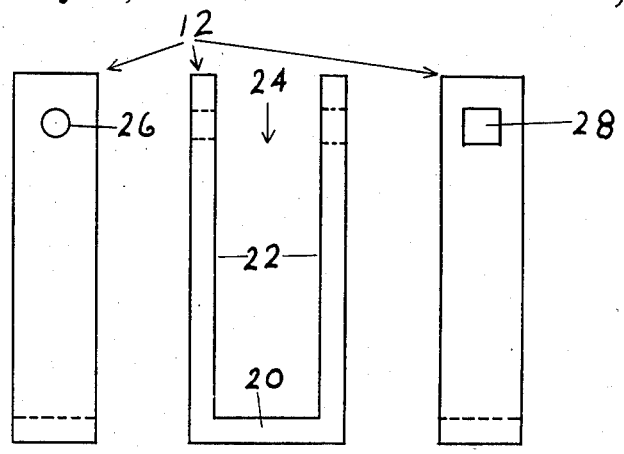
FIGS. 4A, 4B and 4C are three different side views, respectively, of the U-shaped stem employed in the holder of FIG. 1.

FIGS. 4A–4C show the U-shaped stem 12 in detail. The stem comprises a central member 20 and two side members 22. The side members define an opening 24 between them. One of the side members has a round hole 26 and the other a square hole 28 to receive the pin 14.

Figures 5A, 5B, 5C:
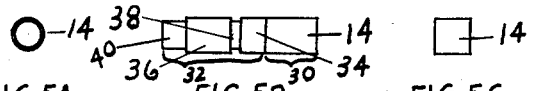
FIGS. 5A, 5B and 5C are three different side views, respectively, of the pin employed in the holder of FIG. 1.

FIGS. 5A–5C show the pin 14 in detail. The pin has a first portion 30 along its length with a square cross-section and a second portion 32 with various circular cross-sections. The portion 32 has sections 34 and 36 which are of the same width or diameter as the square cross-section of the portion 30. Two other sections 38 and 40 of the portion 32 are of a lesser diameter. The section 38 is adapted to receive the end of the spring 18 whereas the section 40 is adapted to fit into the round hole 26 in the stem 12.

Figures 6A, 6B:
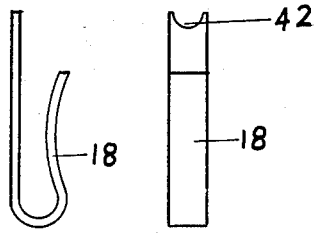
FIGS. 6A and 6B are two side views of the spring employed in the holder of FIG. 1.

FIGS. 6A and 6B show the spring 18 in detail. This spring is constructed with a semicircular cutout portion 42 at one end which fits into the section 38 of the pin 14. The radius of curvature of the cutout portion 42 matches that of the section 38.

Figures 7A, 7B, 7C:
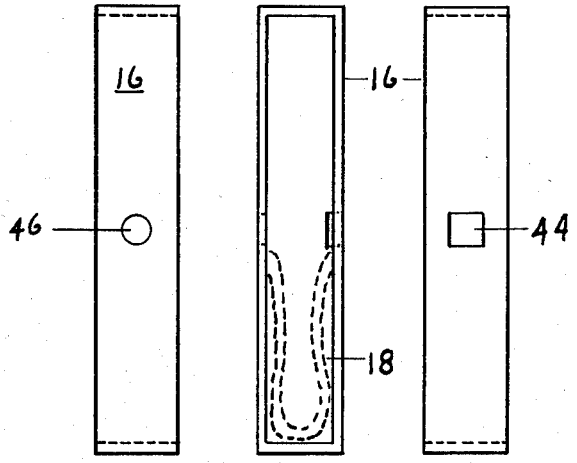
FIGS. 7A, 7B and 7C are three side views, respectively, of the locking member employed in the holder of FIG. 1.
Figure 8:
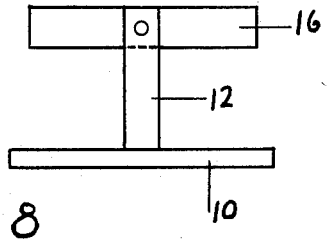
FIG. 8 is a side elevation view of an assembled item of jewelry (a cuff link) incorporating the holder of FIG. 1.

FIGS. 7A, 7B and 7C illustrate the locking member 16. The locking member is hollow so as to accomodate the spring 18 shown in position in dashed lines. At the center of one side of the locking member is a square hole 44; at the center of the other side is a round hole 46. The cross-sectional shape and size of the square hole 44 matches that of the portion 30 of the pin 14. The round hole 46 is only slightly smaller in diameter than the sections 34 and 36 of the pin 14. As may be seen by a comparison of FIGS. 7B and 4B, the locking member 16 is smaller in width than the distance between the two side members 22 of the stem 12.

There has thus been shown and described a novel self-locking holder for an item of jewelry such as a cuff link which fulfills all the objects and advantages sought therefore. Many changes, modifications, variations and other uses and applications of the subject invention will, however, become apparent to those skilled in the art after considering this specification and the accompanying drawings which disclose the preferred embodiment thereof. All such changes, modifications, variations and other uses and applications which do not depart from the spirit and scope of the invention are deemed to be covered by the invention which is to be limited only by the claims which follow.

I claim:

1. A self-locking holder for a cuff link comprising, in combination:

(a) a U-shaped stem adapted to hold thereon the cuff link said stem having two side members defining an opening therebetween;

(b) a pin member defining an axis extending between said side members across said opening, said pin member having a cylindrical non-circular cross-section along a first portion of its length near one side member and a cylindrical cross-section along a second portion of its length near the other side member;

(c) a locking member, slidably and rotatably arranged on said pin member within said opening, said locking member having a hole therein for receiving said pin member, the cross-section of said hole on the side thereof adjacent said one side member matching said non-circular cross-section, said locking member being smaller in width than the distance between said two side members; and (d) spring means arranged for biasing said locking member toward said one side member; whereby said locking member may be rotated on said pin member by first sliding it along the axis of said pin member toward said other side member away from said first portion of said pin member, and whereby said locking member is prevented from rotating on said pin member when it is positioned adjacent said one side member with the matching cross-section of said hole disposed over said first portion of said pin member.

2. The self-locking holder defined in claim 1, wherein said two side members of said stem are straight and parallel.

3. The self-locking holder defined in claim 1, wherein said stem has a central member connecting together one end of each of said side members, thereby forming the bottom of the "U".

4. The self-locking holder defined in claim 1, wherein said non-circular cross-section of said pin member is polygonal.

5. The self-locking holder defined in claim 4 wherein said non-circular cross-section of said pin member is square.

6. The self-locking holder defined in claim 5 wherein said matching cross-section of said hole in said locking member is square.

7. The self-locking holder defined in claim 1 wherein said pin member is passed through corresponding holes in said side members.

8. The self-locking holder defined in claim 1 wherein said pin member is fixed with respect to said side members.

9. The self-locking holder defined in claim 1, wherein said locking member is hollow, and wherein said spring means is arranged in the hollow within said locking member and applies a force between said locking member and said pin member.

10. The self-locking holder defined in claim 2, wherein said locking member is elongate and may be locked in at least two positions: (1) a first position in which it is parallel to said two side members and (2) a second position in which it is perpendicular to said two side members.

* * * * *